US010928052B2

(12) United States Patent
Ayala et al.

(10) Patent No.: US 10,928,052 B2
(45) Date of Patent: Feb. 23, 2021

(54) HANDS-FREE HEADLAMP SYSTEM

(71) Applicants: Rita Ayala, Miami, FL (US); Santiago Ayala, Miami, FL (US)

(72) Inventors: Rita Ayala, Miami, FL (US); Santiago Ayala, Miami, FL (US)

( * ) Notice: Subject to any disclaimer, the term of this patent is extended or adjusted under 35 U.S.C. 154(b) by 0 days.

(21) Appl. No.: 15/681,269

(22) Filed: Aug. 18, 2017

(65) Prior Publication Data

US 2018/0051870 A1 Feb. 22, 2018

Related U.S. Application Data

(60) Provisional application No. 62/376,902, filed on Aug. 18, 2016.

(51) Int. Cl.

| | |
|---|---|
| ***F21V 23/00*** | (2015.01) |
| ***F21V 23/04*** | (2006.01) |
| ***A42B 3/04*** | (2006.01) |
| ***A41D 1/00*** | (2018.01) |
| ***A41D 20/00*** | (2006.01) |
| ***A42B 1/244*** | (2021.01) |
| *F21V 33/00* | (2006.01) |
| *F21S 9/02* | (2006.01) |
| *F21V 21/084* | (2006.01) |
| *F21Y 115/10* | (2016.01) |

(52) U.S. Cl.

CPC ..... *F21V 23/0471* (2013.01); *A41D 1/002* (2013.01); *A41D 20/00* (2013.01); *A42B 1/244* (2013.01); *A42B 3/0446* (2013.01); *F21S 9/02* (2013.01); *F21V 21/084* (2013.01); *F21V 33/0008* (2013.01); *F21Y 2115/10* (2016.08)

(58) Field of Classification Search

CPC ..... F21V 23/0471; F21V 21/084; F21V 33/0008; F21V 23/0442; F21V 21/088; F21V 21/0832; F21V 33/00; A41D 1/002; A41D 20/00; F21S 9/02; A42B 1/244; A42B 3/0446; A42B 1/242; A42B 1/24; A42B 3/0433; A42B 3/044

See application file for complete search history.

(56) References Cited

U.S. PATENT DOCUMENTS

| | | | | |
|---|---|---|---|---|
| 4,156,942 | A * | 6/1979 | Isfeld | A42B 1/10 2/422 |
| 6,764,194 | B1 * | 7/2004 | Cooper | F21V 21/084 362/103 |
| 6,955,444 | B2 | 10/2005 | Gupta | |
| 7,008,074 | B1 | 3/2006 | Halm | |

(Continued)

*Primary Examiner* — Y M. Quach Lee

(74) *Attorney, Agent, or Firm* — Runyan Law; Charles Runyan

(57) ABSTRACT

A hands-free headlamp system for an item of headwear, the hands-free headlamp system including: a housing including headwear fastener, the headwear fastener configured to attach to the item of headwear an energy storage affixed to the housing; a light source mechanically coupled to the housing and electrically coupled to the energy storage; a motion sensor mechanically coupled to the housing and electrically coupled to the energy storage, the motion sensor configured to detect hand motion of a user; a controller mechanically coupled to the housing, electrically coupled to the energy storage, and communicably coupled to the motion sensor, the controller configured to operate the light source in response to detected hand motions of the user.

2 Claims, 5 Drawing Sheets

(56) References Cited

U.S. PATENT DOCUMENTS

| | | | | |
|---|---|---|---|---|
| 7,370,991 | B1 | 5/2008 | Ellis-Fant | |
| 8,653,702 | B2 | 2/2014 | Saleh | |
| 9,226,372 | B2 | 12/2015 | Johnson et al. | |
| 9,702,534 | B1 * | 7/2017 | Brion | F21V 21/084 |
| 2006/0044800 | A1 * | 3/2006 | Reime | B60Q 3/82 362/276 |
| 2006/0092022 | A1 * | 5/2006 | Cehelnik | G06F 3/011 340/561 |
| 2006/0285315 | A1 | 12/2006 | Tufenkjian | |
| 2008/0205036 | A1 * | 8/2008 | Tarter | F21V 21/30 362/105 |
| 2011/0144453 | A1 * | 6/2011 | Kovarik | A61B 5/1114 600/300 |
| 2015/0003048 | A1 | 1/2015 | Chang | |
| 2015/0276188 | A1 * | 10/2015 | Osborn | F21V 21/0885 362/106 |
| 2016/0076747 | A1 * | 3/2016 | Lively | A61B 90/361 362/105 |
| 2016/0238220 | A1 * | 8/2016 | Chang | F21V 23/0471 |

* cited by examiner

HANDS-FREE HEADLAMP SYSTEM

CROSS REFERENCE TO RELATED APPLICATION

The present application is related to and claims priority to U.S. Provisional Patent Application No. 62/376,902 filed Aug. 18, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of illumination and more specifically relates to wearable illumination sources.

2. Description of Related Art

A headlamp is a light source affixed to the head for outdoor activities at night or in dark conditions such as caving, orienteering, hiking, skiing, backpacking, camping, mountaineering or mountain biking. Headlamps may also be used in adventure races. Headlamps are often used by workers in underground mining, search and rescue, surgeons, and by other workers who need hands-free lighting.

Many healthcare professionals, such as surgeons, dentists, and nurses, could use increased light during procedures. A light may be turned on and off several times throughout a procedure. Each time the individual has to reach up and activate the light with their hand or have another party turn it on or off. This can cause contamination to both the goggles and the user's gloves and is inconvenient. The individual must then discard their gloves and replace them which is wasteful and time consuming. In addition, using the hands to activate the light can cause the spread of diseases in a medical setting. A more effective means is needed.

U.S. Pub. No. 2015/0003048 to Byung J. Chang relates to a motion-activated medical/dental headlamp. The described motion-activated medical/dental headlamp includes a headlamp which incorporates an infrared sensor enabling the light to be turned ON and OFF without physical contact. The system includes a light source and a mechanism for coupling the light source to eyeglass frames or to a headband. A power supply and control unit is disposed remotely from the light source and is interconnected to the light source through an electrical cable. An infrared (IR) motion sensor is interconnected to the power supply and control unit, and electrical circuitry within the power supply and control unit is operative to turn the light source ON and OFF is response to the detection of a hand or other body part by the sensor. In the preferred embodiment, the light source includes a light-emitting diode (LED), and the IR detector is a passive IR pyroelectric sensor. The IR sensor may be attached to clothing, eyeglass frames, a headband, or the light source itself.

BRIEF SUMMARY OF THE INVENTION

In view of the foregoing disadvantages inherent in the known illumination means art, the present disclosure provides a novel hands-free headlamp system. The general purpose of the present disclosure, which will be described subsequently in greater detail, is to provide a hands-free headlamp system for an item of headwear, the hands-free headlamp system comprising: a housing including headwear fastener, the headwear fastener configured to attach to the item of headwear an energy storage affixed to the housing; a light source mechanically coupled to the housing and electrically coupled to the energy storage; a motion sensor mechanically coupled to the housing and electrically coupled to the energy storage. The motion sensor is configured to detect hand motion of a user; a controller mechanically coupled to the housing, electrically coupled to the energy storage, and communicably coupled to the motion sensor, the controller is configured to operate the light source in response to detected hand motions of the user.

A hands-free headlamp system is disclosed herein. The hands-free headlamp system includes a housing which may include headwear fastener. The headwear fastener is configured to attach to the item of headwear with an energy storage affixed to the housing. A light source is preferably mechanically coupled to the housing and electrically coupled to the energy storage. A motion sensor mechanically is coupled to the housing and electrically coupled to the energy storage. The motion sensor configured to detect hand motion of a user; a controller mechanically coupled to the housing, electrically coupled to the energy storage, and communicably coupled to the motion sensor, the controller configured to operate the light source in response to detected hand motions of the user.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a hands-free headlamp system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an illumination device and more particularly to a hands-free headlamp system as used to improve the wearable illumination device.

Generally, the hands-free headlamp system for an item of headwear comprises: a housing including headwear fastener, the headwear fastener configured to attach to the item of headwear an energy storage affixed to the housing; a light source mechanically coupled to the housing and electrically coupled to the energy storage; a motion sensor mechanically coupled to the housing and electrically coupled to the energy storage, the motion sensor configured to detect hand motion of a user; a controller mechanically coupled to the housing, electrically coupled to the energy storage, and communicably coupled to the motion sensor, the controller configured to operate the light source in response to detected hand motions of the user.

The aforementioned headwear may include a helmet, eyewear, a headband, a hat, or similar types of headwear. The light source may include at least one light-emitting diode (LED) which receives power from an energy source that may include one or more batteries that are removable and replaceable, or may include one or more batteries that are rechargeable. The motion sensor may include an infrared (IR) sensor which is configured to detect body heat of a hand of the user. The controller is able to toggle between illumination and an inactive state based on input from the motion sensor. The controller is further configured to activate the light source in response to hand motions of the user having a duration of at least 1.5 seconds. The motion sensor is positioned on the housing so as to be located between a temple and an ear of the user while attached to the item of headwear and when the item of headwear is worn by the user. The motion sensor has a detection range limited to 6 inches. The motion sensor is further configured to detect hand motions of the user on both sides of the item of headwear while attached to the item of headwear. The light source may be a directional light source configured to project a focused beam of light or may be configured to project a broad beam of light that is broader than the focused beam of light.

Figure 1:
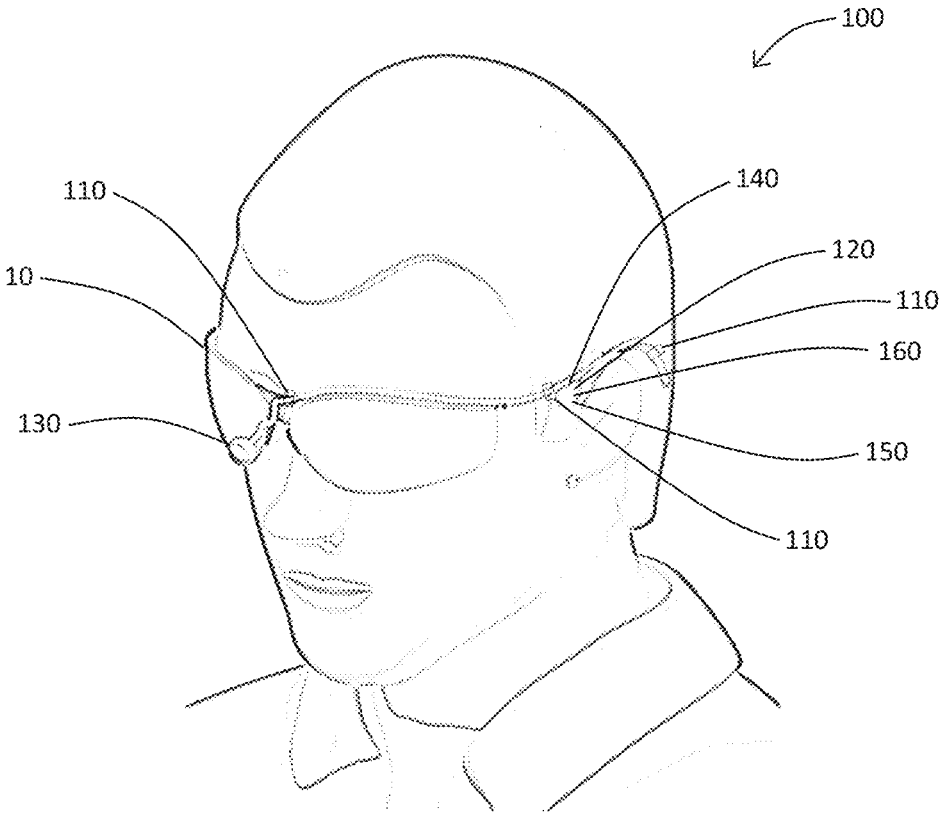
FIG. 1 is a perspective view of the hands-free headlamp system during an 'in-use' condition, according to an embodiment of the disclosure.

Referring now more specifically to the drawings by numerals of reference, there is shown in FIGS. 1-4, various views of a hands-free headlamp system 100. FIG. 1 shows a hands-free headlamp system 100 during an 'in-use' condition, according to an embodiment of the present disclosure. As Illustrated, the hands-free headlamp system 100 may include a housing 120 which may include headwear fastener 110, the headwear fastener 110 configured to attach to the item of headwear; an energy storage affixed to the housing 120; a light source 130 mechanically coupled to the housing 120 and electrically coupled to the energy storage 160; a motion sensor 140 mechanically coupled to the housing 120 and electrically coupled to the energy storage 160, the motion sensor 140 configured to detect hand motion of a user; a controller 150 mechanically coupled to the housing 120, electrically coupled to the energy storage 160, and communicably coupled to the motion sensor 140, the controller 150 configured to operate the light source 130 in response to detected hand motions of the user. The motion sensor 140 is preferably positioned on the housing 120 so as to be located between a temple and an ear of the user while attached to the item of headwear.

Figure 2:
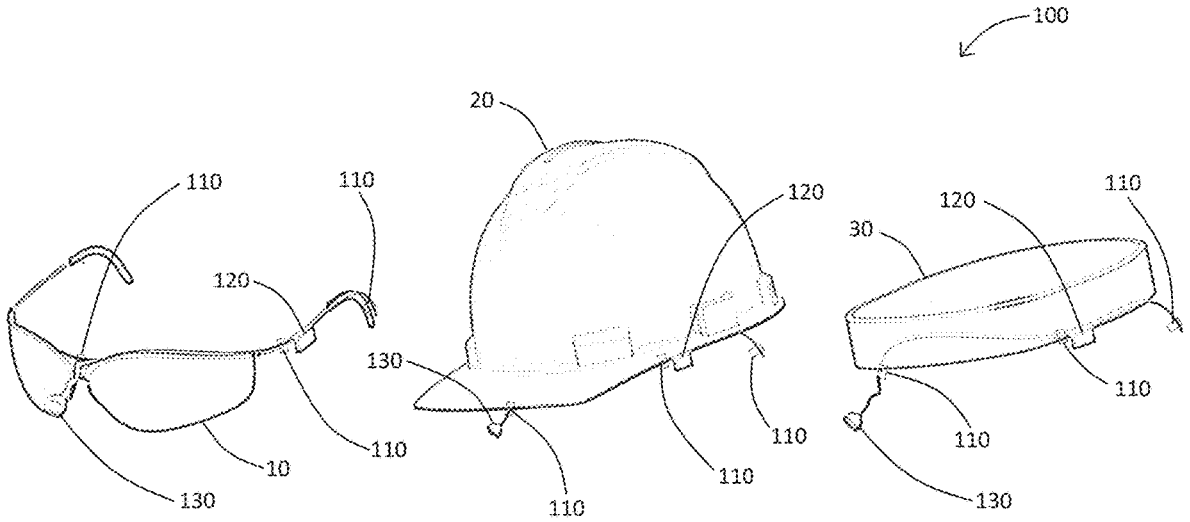
FIG. 2 is a perspective view of the hands-free headlamp system of FIG. 1, according to different embodiments of the present disclosure.

FIG. 2 shows a perspective view of the hands-free headlamp system 100 of FIG. 1, according to an embodiment of the present disclosure. As above, the hands-free headlamp system 100 may include a housing 120 which may include headwear fastener 110, the headwear fastener 110 configured to attach to the item of headwear. An energy storage 160 is affixed to the housing 120; a light source 130 mechanically coupled to the housing 120 and electrically coupled to the energy storage 160. The motion sensor 140 is mechanically coupled to the housing 120 and electrically coupled to the energy storage 160, the motion sensor 140 configured to detect hand motion of a user; a controller 150 mechanically coupled to the housing 120, electrically coupled to the energy storage 160, and communicably coupled to the motion sensor 140. The controller 150 is configured to operate the light source 130 in response to detected hand motions of the user.

Figure 3:
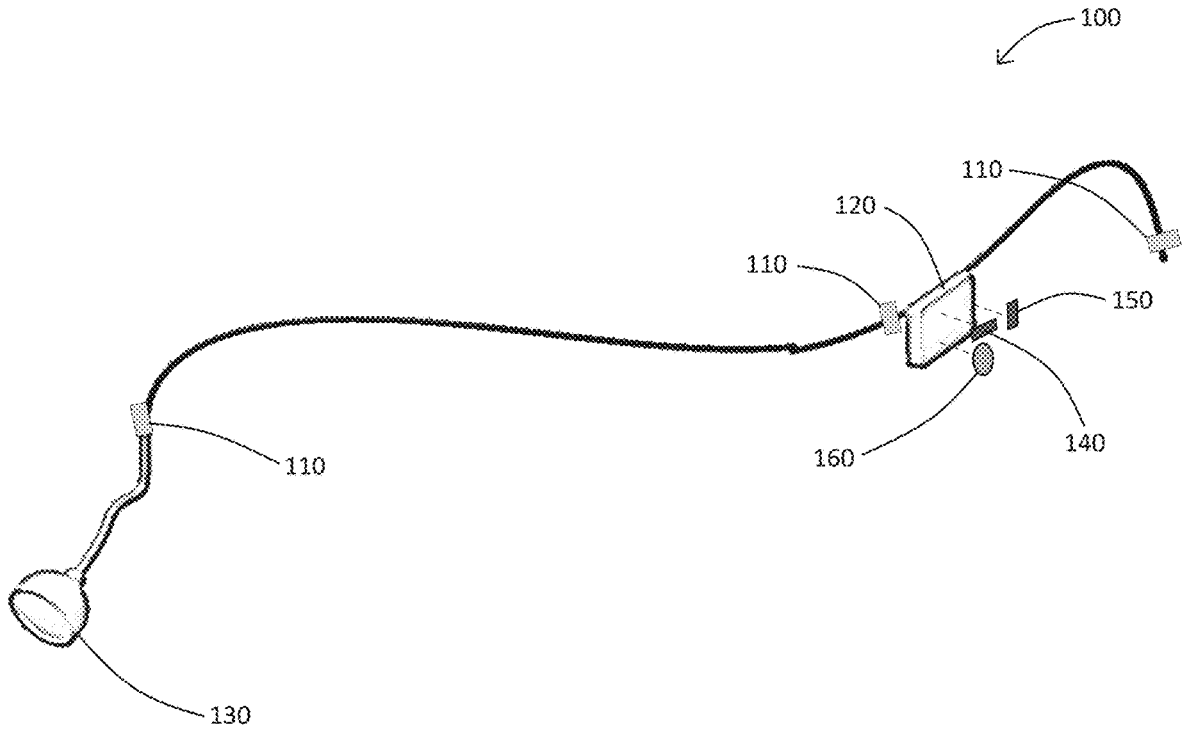
FIG. 3 is a side perspective view of the hands-free headlamp system of FIG. 1, according to an embodiment of the present disclosure.

FIG. 3 shows a side perspective view of the hands-free headlamp system 100 of FIG. 1, according to an embodiment of the present disclosure. As above, the hands-free headlamp system 100 may include a housing 120 which may include headwear fastener 110. The headwear fastener 110 is configured to attach to the item of headwear; an energy storage 160 affixed to the housing 12. A light source 130 is mechanically coupled to the housing 120 and electrically coupled to the energy storage 160. The motion sensor 140 is mechanically coupled to the housing 120 and electrically coupled to the energy storage 160. The motion sensor 140 configured to detect hand motion of a user. The controller 150 is preferably mechanically coupled to the housing 120, and electrically coupled to the energy storage 160, and being communicably coupled to the motion sensor 140. The controller 150 is configured to operate the light source 130 in response to detected hand motions of the user.

Figure 4:
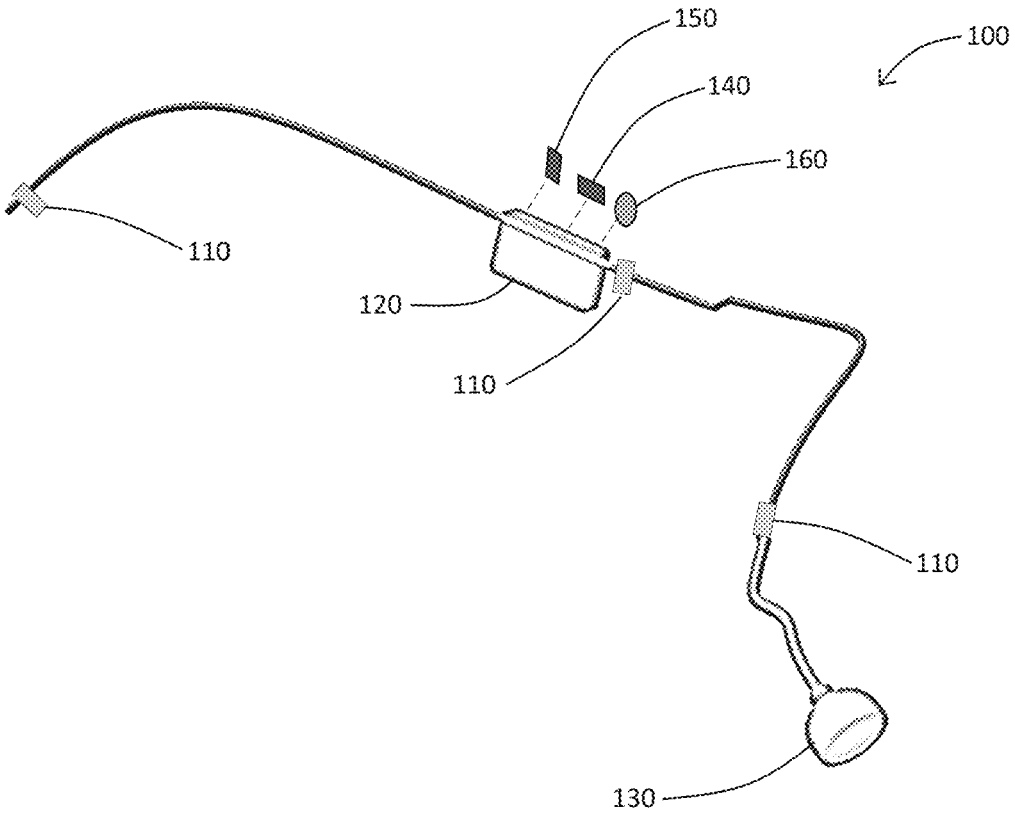
FIG. 4 is a side perspective view of the hands-free headlamp system of FIG. 1, according to an embodiment of the present disclosure.

FIG. 4 shows a front perspective view of the hands-free headlamp system 100 of FIG. 1, according to an embodiment of the present disclosure. As above, the hands-free headlamp system 100 may include a housing 120 which may include headwear fastener 110. The headwear fastener 110 is configured to attach to the item of headwear; an energy storage 160 affixed to the housing 120; a light source 130 mechanically coupled to the housing 120 and electrically coupled to the energy storage 160; a motion sensor 140 mechanically coupled to the housing 120 and electrically coupled to the energy storage 160, the motion sensor 140 configured to detect hand motion of a user; a controller 150 mechanically coupled to the housing, electrically coupled to the energy storage 160, and communicably coupled to the motion sensor 140, the controller 150 configured to operate the light source 130 in response to detected hand motions of the user, as previously mentioned.

Figure 5:
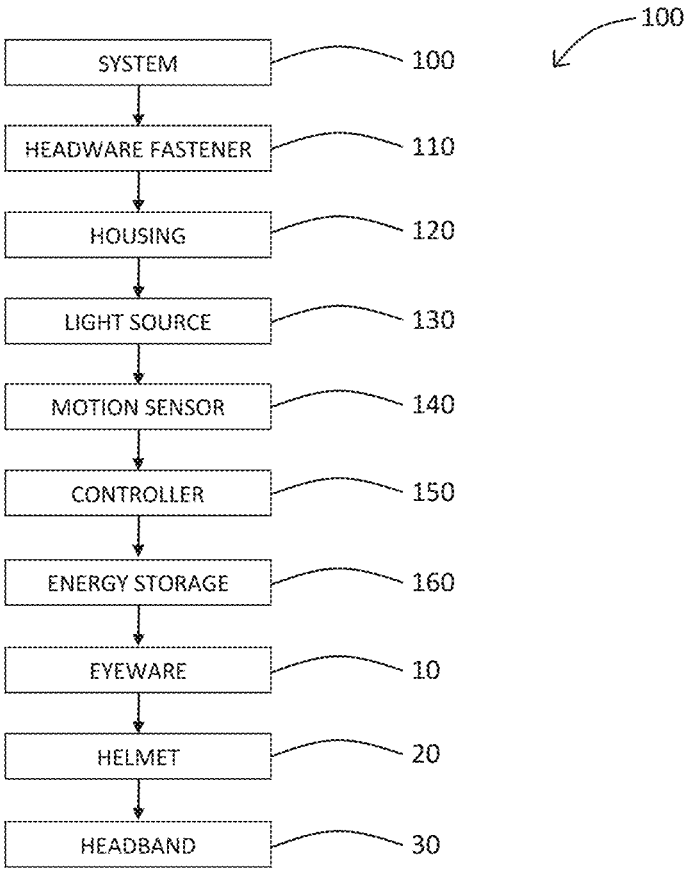
FIG. 5 is a listing of components for use with the hands-free headlamp system, according to an embodiment of the present disclosure.

FIG. 5 is a listing of components for use with the hands-free headlamp system 100, according to an embodiment of the present disclosure as described in FIGS. 1-4. A method of using the present invention may be as follows: providing the device; using the device to illuminate as desired and controlling the illumination via waving next to the temple or other as desired.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appending claims:

1. A headlamp system comprising:

a first housing including a headwear fastener;

an energy storage affixed to the housing;

a headlamp connected to the housing, electrically connected to the energy storage, and oriented to illuminate a workspace; and a controller connected to the housing, electrically connected to the energy storage, and connected to the headlamp; and a second housing including a motion sensor connected to the controller.

2. The system of claim 1 wherein the motion sensor includes an infrared (IR) sensor.

* * * * *